US005090130A

United States Patent [19]

Gudausky, Jr.

[11] Patent Number: 5,090,130

[45] Date of Patent: Feb. 25, 1992

[54] APPARATUS FOR TESTING THE TRUENESS OF ARCHERY ARROWS

[76] Inventor: William V. Gudausky, Jr., 22253 Chestnutridge Rd., Kildeer, Ill. 60047

[21] Appl. No.: 667,539

[22] Filed: Mar. 11, 1991

[51] Int. Cl.[5] ..... G01B 5/25

[52] U.S. Cl. ..... 33/533

[58] Field of Search ..... 33/549, 550, 533, 501

[56] References Cited

U.S. PATENT DOCUMENTS 2,470,404 5/1949 Kloos ..... 33/533

2,876,822 3/1959 Groves ..... 33/533

3,163,305 12/1964 Stanton ..... 33/533

*Primary Examiner*—Harry N. Haroian

*Attorney, Agent, or Firm*—Charles F. Meroni, Jr.

[57] ABSTRACT

An archery arrow testing apparatus which comprises a pair of upright arrow support stands. The apparatus further includes a pair of wooden or plastic pedestals. The stands each have a pair of spaced apart thin flat upright legs. Vertically extending slots are provided in the wooden pedestals. The slots are sized to receive and support the thin flat upright legs when the legs are engaged in the slots. An adjustably mountable rod is mounted in horizontally extending holes in the pedestals with opposite ends of the rod engaged in the holes connecting the pedestals together in a supported upright position. Archery arrow testing means is provided which comprises sets of revolving thin metal discs. Means is further provided for mounting a series of the discs in pairs on each of the pedestals with the discs being rotatable relative to the pedestals enabling an archery arrow to be spun in circumferential orbit on the discs for a human eye to scrutinize to ascertain trueness of an orbiting archery arrow.

8 Claims, 2 Drawing Sheets

APPARATUS FOR TESTING THE TRUENESS OF ARCHERY ARROWS

FIELD OF THE INVENTION

My new and improved archery arrow testing apparatus is a precision instrument that will not tolerate abuse and must be handled with care. With proper use it will enable the user to check archery arrows for accuracy; straightness, nock and point alignment, and also it can be used to check horizontal and vertical balance thus eliminating old techniques for arrow testing and enabling tests to be more accurately carried out.

My apparatus includes a pair of arrow support stands which possess wooden pedestals or bases. These bases are mounted upon a stiff metallic rod and are movable on the rod into selected preset adjusted positions for enabling the stands to be correctly positioned relative to one another and relative to the length of the particular arrow that is being tested. Where longer arrows are to be tested, the stands will be wider apart than where the arrows are shorter all as will be further explained in greater detail hereafter. In the past, arrows have generally been scrutinized by human eye and no known arrow testing apparatus is believed to be on the marketplace and available for public purchase at this point in time. My new and improved archery arrow testing apparatus eliminates the difficulties that are encountered where an archer attempts to evaluate the trueness of archery arrows by human eye alone in providing an arrow testing apparatus that can be operated in such a way that all parts of an arrow can be viewed as it is rotated and supported by my arrow testing stands. If imperfections are found in the arrowhead, the shaft, the shape and/or disposition of the feathers on the shaft, or in the nock, adjustments can be made to the arrow, and then the arrow can be quickly retested to determine whether the adjustments have cured the defect. Through the use of my archery arrow testing apparatus, an archer or an arrow sales outlet can quickly determine if the arrows being used or sold can function properly when released into flight toward an intended target.

SUMMARY OF THE INVENTION

According to important features of my invention, I have provided an archery arrow testing apparatus comprising a pair of upright arrow support stands including a pair of pedestals. The stands each have a pair of spaced apart thin flat upright legs, vertically extending slots are located in the wooden pedestals and are sized to receive and support the thin flat upright legs when the legs are engaged in the slots. Horizontally extending holes are provided in the pedestals with opposite ends of an adjusting rod engaged in the holes connecting the pedestals together in a supported upright position. Pairs of revolving thin metal discs and means is provided mounting the discs on each of the pedestals with the discs being rotatable relative to the pedestals enabling an archery arrow to be spun in circumferential orbit on the discs for human eye scrutiny to ascertain trueness of an orbiting archery arrow.

Other features of my archery arrow testing apparatus relate to the means for mounting the sets of revolving thin metal discs being arranged to support the discs in such a way that the discs all are provided with a horizontal axes but with the axes being spaced from one another in such a way that each set of discs are oriented to define a nip for receiving an arrow.

Yet other features of my archery arrow testing apparatus relate to each of the pedestals being comprised of three pieces including end pieces and a middle piece, the middle piece having a slot therein, all of the pieces being relatively flat, and glue means is disposed between the flat pieces securing the pieces in side-by-side relation and with the thin flat upright legs being mounted in said slot.

It is an important object of my invention to provide an apparatus for testing the trueness of archery arrows where the arrows can be supported on the apparatus and rotated, and viewed by the human eye, to determine whether the arrow is rotating in a uniform orbit or whether imperfections must be addressed in the straightness of the arrow, and the like. If adjustments are required to correct the arrow shaft or nock or point alignment or feather disposition, these imperfections can be cured and the arrow can be retested to be sure that the arrow possesses the required trueness to travel in flight for the purpose of hitting an intended target free of equipment problems.

BRIEF DESCRIPTION OF THE DRAWINGS

Other objects and features of my invention will become more fully apparent in view of the following detailed description of the drawings illustrating the single embodiment.

DESCRIPTION OF A PREFERRED EMBODIMENT

Figure 1:
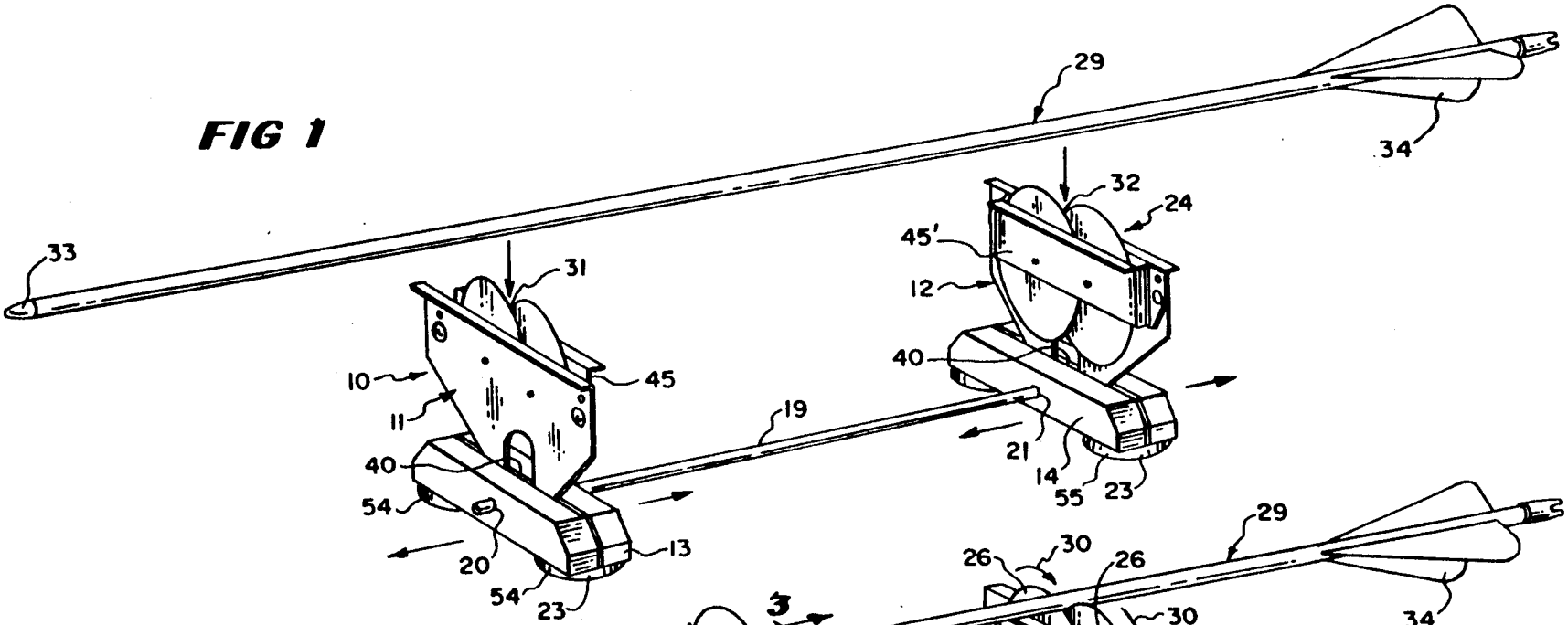
FIG. 1 is a diagrammatic perspective view showing the way in which an archery arrow can be mounted on my apparatus for testing the trueness of an orbiting arrow.

I have indicated my archery arrow testing apparatus with reference numeral 10 as seen in the drawings. The apparatus 10 includes a pair of upright arrow support stands 11 and 12, each of which is of a multi-part construction and each is constructed in an identical manner. The stands 11 and 12 include a pair of wooden pedestals or bases 13 and 14. The stands have a pair of spaced upright thin, flat upright legs 15,15 and 16,16. Vertically upwardly opening grooves or slots 40,40 are provided in the wooden pedestals 13 and 14. The slots 40,40 are sized to receive and support the thin flat lower ends of upright legs 15,15 and 16,16 when the legs are engaged in grooves or slots 43 in spacer pieces hereafter described.

A metallic steel spacer rod 19 is positioned between the pedestals 13 and 14, and in alignment with horizontally extending holes 20 and 21 which are provided in the pedestals. Opposite ends 22 of the rod 19 are engaged in the holes 20 and 21, and serve to connect the pedestals 13 and 14 together in a supported upright adjusted position. Slotted spacer pieces 23,23 (FIG. 6) are mounted internally of the bases 13 and 14 which assist in defining the grooves or slots 17 and 18.

Archery arrow testing means 24 (FIG. 1) is provided. The means includes sets of revolving thin metal discs indicated at 25,25 and 26,26 (FIG. 2) mounted on the pedestals 13 and 14. Means in the form of pins 27,27 and 28,28 (FIG. 2) are provided on the respective wooden pedestals 13 and 14 for securing the discs to the pedestals 13 and 14. It will be seen by a study of the directional arrows shown in FIGS. 2, 3 and 4 that the discs 25,25 and 26,26 are adapted to revolve on the pins 27,27 and 28,28 when arrows 29 are to be spun on the discs to check the trueness of the arrows 29.

Mounted on my archery arrow testing apparatus 10 is an arrow indicated generally at 29. This arrow is one that needs to be checked to determine whether it will orbit in a ture orbital path free of any wobble. By mounting the arrow 29 on the archery arrow testing apparatus, certain eye tests can be more easily performed as will hereafter be explained. It will further be observed in FIGS. 1 and 2 that the arrow 29 must be balanced between the wooden pedestals 13 and 14 so that it can be supported at intermediate points without falling off the apparatus 10.

Figure 2:
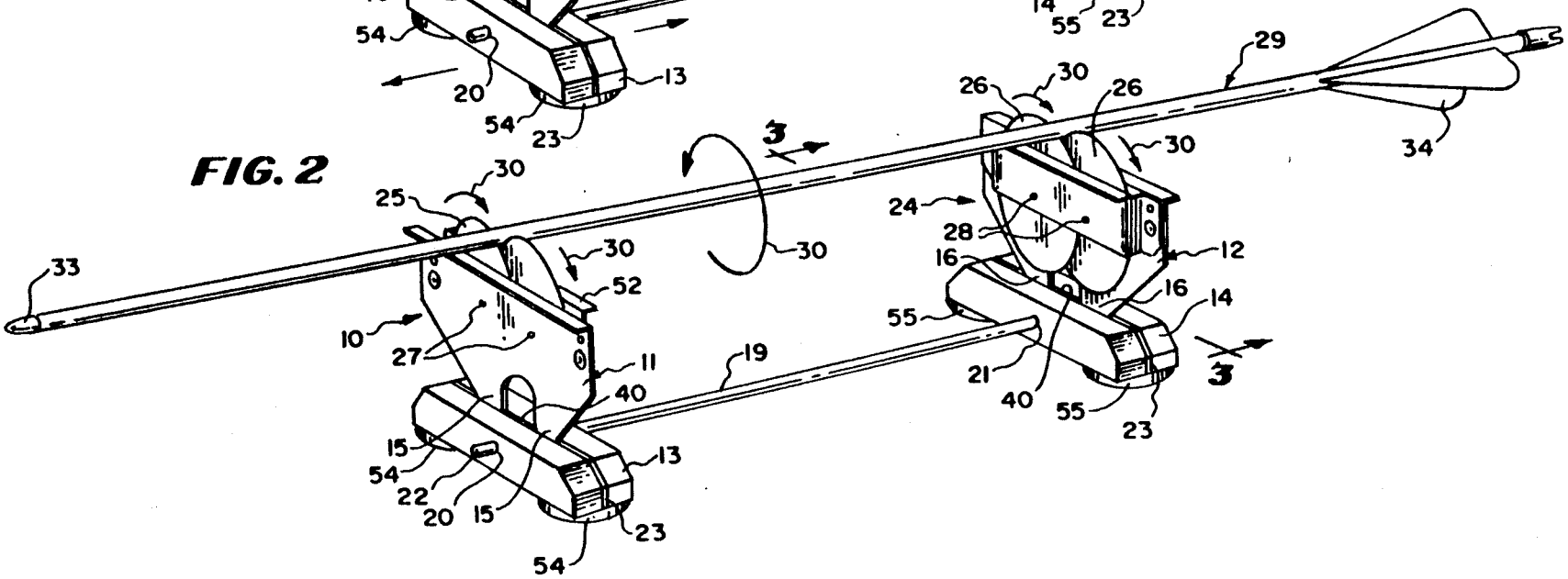
FIG. 2 is a diagrammatic perspective view similar to FIG. 1 only illustrating the archery arrow mounted on my apparatus.

The arrow 29 is mounted upon the thin metal discs 25,25 and 26,26, in nips 31 and 32 and is then caused to be rotated by generating a rotative movement in the arrow by the application of a twisting motion to the archery arrow as indicated by the reference numeral 30 (FIG. 3) which serves to identify the induced direction of rotation being applied to the arrow 29 as seen in FIG. 2.

Figure 3:
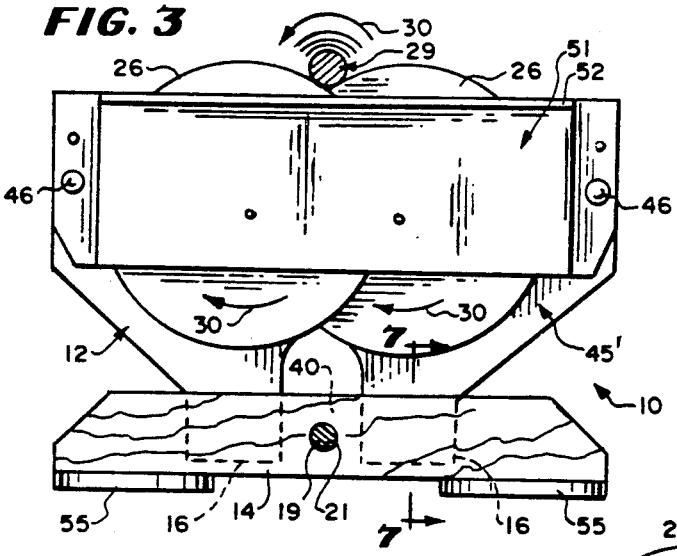
FIG. 3 is an enlarged partially sectioned view shown on the line 3—3 looking in the direction indicated by the arrows as seen in FIG. 2.

When the rotative force is applied to the archery arrow 29, the thin metal discs 25,25 and 26,26 are caused to rotate in the direction indicated by the arrows 31 and 32 as further seen in FIG. 2. The partial section shown in FIG. 3 shows the same arrows and the same rotative effect that can be brought about by rotating the arrow 29 in the direction again indicated at 30. When the arrow 29 is spun on the apparatus 10, the observer can detect whether arrow head 33 of the arrows 29 or feathers 34 are misaligned. Further, if any impacts have been caused to be applied to a side of the arrow shaft 29 there may be some tendency for the damaged portion of the arrow to move to a position where the distorted part of the shaft is on the bottom side of the arrow after the arrow has completed its rotative movement. Once the observer determines where the misalignment may be located, then steps can be taken to correct the misalignment, such as by remounting the arrow head on the shaft or one of the feathers, or whatever as may be required checking for misalignment is discussed hereafter.

Figure 7:
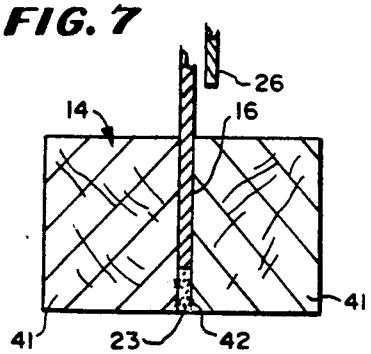
FIG. 7 is an enlarged fragmentary vertical section as viewed on the line 7—7 looking in the direction indicated by the arrows as seen in FIG. 3.
Figure 6:
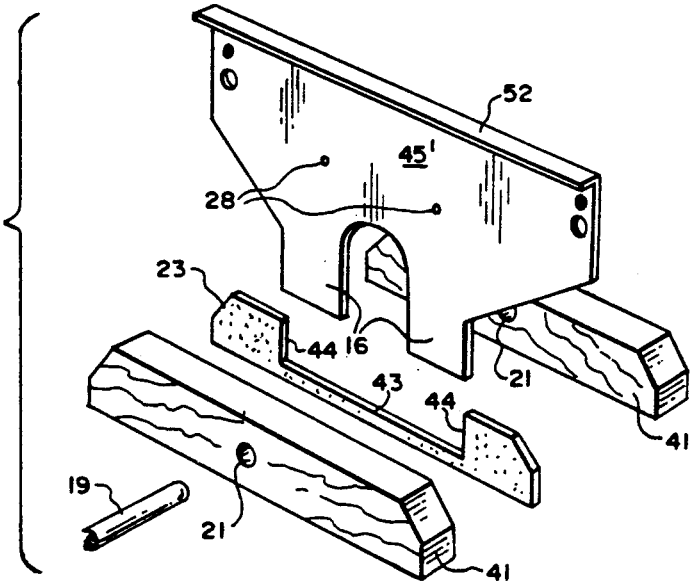
FIG. 6 is an enlarged fragmentary exploded view of my archery arrow testing apparatus.

Each of the pedestals or bases are of an identical construction as shown generally in FIG. 6. Each base includes a pair of elongated wooden blocks 41,41. Positioned between the blocks is the spacer piece 23. Glue 42 or other suitable adhesive secures the blocks 41,41 to the spacer piece 23 as shown in FIG. 7 and with a slot or groove 40 provided in the blocks.

The spacer piece 23 has a C-shaped edge or slot edge 43 which includes a pair of upright edges 44,44 which serve to co-act with side edges of the upright legs 15,15 or 16,16 depending on which stand is mounted with a given spacer piece 23 in the slot 40. These edges serve to lock the legs 15,15 or 16,16 against side-by-side movement when the components are assembled together.

Figure 4:
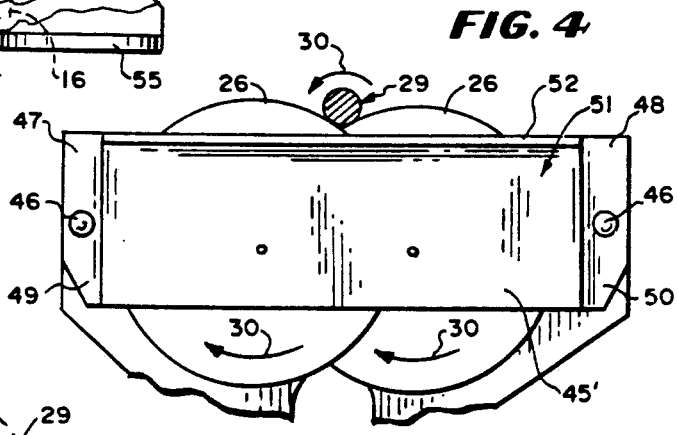
FIG. 4 is an enlarged fragmentary partially sectioned view similar to FIG. 3 only viewed from an opposite side.
Figure 5:
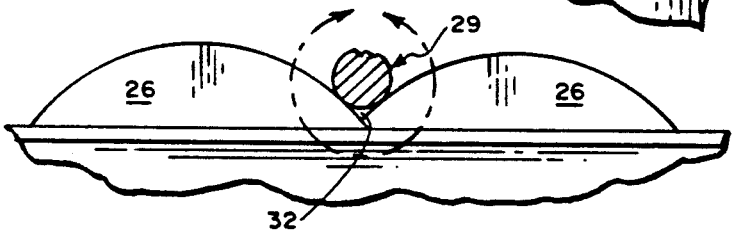
FIG. 5 is an enlarged fragmentary view of my archery testing apparatus with an archery arrow mounted thereon.

The upright stands 11 and 12 are identical construction and include a pair of metallic sheet-like members 44 and 45'. The members 45 and 45' are secured together by means of suitable fasteners which may be in the form of rivets as indicated at 46—46 (FIGS. 3 and 4).

The flat metallic sheet-like member 44 has angled L-shaped members or leg portions 47 and 48. Each leg portion has a terminal leg 49 and 50, and it is these legs 49 and 50 that are riveted or otherwise fastened to the front sheet-like member 45. Between the angle members 47 and 48 is a connecting member 51 and this connecting member 51 carries the pins 27,27 that support the thin metal discs 25,25 or 26,26 thereon. The connecting portion 51 has an outwardly leg 52.

The opposing sheet-like member 45 has a similar leg 53 that is turned in an opposite direction for strengthening the respective members 44 and 45 in view of their narrow thickness and also serving as a safety protector to turn away potential cutting edge at right angles to the metal discs 25,25 or 26,26. It will be appreciated that the pins 27,27 and 28,28 are secured in holes and supported in the holes in opposite ends of the sheet-like members 44 and 45.

As will be observed from FIG. 1, it will be seen that the stands 11 and 12 are mounted upon pairs of pads 54,54 and 55,55. These pads can be made from rubber or plastic or any suitable material and can be glued or otherwise suitably secured to the bottom sides of the wooden pedestals bases 13 and 14.

When it is desired to adjust the position of the stands 11 and 12 relative to one another so that the arrow 29 can be properly positioned and supported at the desired locations, the stands can be moved towards or away from one another by adjusting the relative position of the wooden rod 19 with respect to the wooden pedestals or bases 13 and 14. This can be accomplished by moving the wooden rod in the base holes 20, 21 as seen in FIG. 6. It will thus be seen that I have provided a new and more economical archery arrow testing apparatus having a new and improved base construction that can be more economically manufactured and yet which can be easily adjusted to accommodate a variety of different sized arrows or arrows having different lengths when different sized arrows are to be tested on my arrow testing apparatus to determine imperfections in the construction of the arrows whether the tips or the feathers are incorrectly mounted or whether the arrow has been damaged or formed incorrectly along its shaft to generate a wobbling flight pattern.

SETTING UP

The shaft should be set with approximately ⅓ its length between uprights for ideal results. A base having a length of 12 inches is adequate to support arrows up to 36 inches in length.

HORIZONTAL BALANCE (PERCENT FRONT OF CENTER)

Measure the arrow first from its point to its nock. If it is 30 inches as an example, then divide 30 by two. Then mark the center of arrow between its opposite ends at 15 inches. Then find the arrow balance, and move the arrow to the left or to the right on one upright until balance is achieved. Mark. Measure this distance from center, and it may be 3 inches. FOC. Divide 3 into 30=10% FOC. Total length of arrow (30) inches, divided by distance FOC (3) inches=(10)% FOC. Highest accuracy will be achieved with the least amount of variation between arrows, % FOC and total weight. Balance can be achieved by adding or subtracting weight to point or tail. To fly the same: arrows should weigh and balance the same.

SPIN CHECK

Place the arrow on the uprights in horizontal balance when centered on the uprights. The arrow should then be spun and the arrow can then be checked for wobble (straightness), point and nock alignment. The higher the spin rate achieved without arrow bounce the straighter the arrow. A low spin rate can best be used to check nock and point alignment.

VERTICAL BALANCE

Arrows must be straight to check for vertical balance. Vertical balance is affected by arrow straightness, vane balance, broadhead balance, and/or a heavy spot in the shaft. You can expect the same performance from an unbalanced arrow as you could from an unbalanced tire on your car.

VANE BALANCE

Normally, if care was taken to glue on vanes leaving no excess amount of glue from vane to vane, then the vanes should be in good balance. Each arrow should be spin checked a number of times. If one vane consistently drops to the bottom after being spun on the upright, that vane is heavy with the arrow being unbalanced. To balance the unbalanced arrow, the excess glue should be removed from that vane, or add a drop or two of glue to the opposite side of the arrow. A balanced arrow will come to rest in a different position after each spin on the uprights. On a hunting shaft with a broadhead, vane balance is checked before installing the broadhead.

BROADHEAD BALANCE

Broadhead balance can be checked on my apparatus. My apparatus can be used to determine the existence of arrow head imbalance where the point is not straight to shaft and also to determine the existence of unbalanced blades.

Broadhead arrows can be spun on the apparatus to determine if the arrow shaft rotates free of point wobble. Each blade must be in balance with the others. A heavy blade will fall to the bottom. To balance remove metal from heavy blade, rotate, or replace. A balanced arrow will come to rest in a different position each spin. This may take some time but testing and repairing the arrow to be sure that it rotates properly can be the difference in taking home a trophy or missing the target.

MAINTAINING ARROWS FOR ACCURACY

The arrows 29 should be spun checked before each hunt, tournament, or as often as possible. It can give the competitor a winning edge. Point, nock, shaft, etc. all must be in balance to each other and if any change is made, then the arrow must be retested to be sure a correct adjustment has been made.

As various possible embodiments may be made in the above invention for use for different purposes and as various changes might be made in the embodiments and method above set forth, it is understood that all of the above matters here set forth or shown in the accompanying drawings are to be interpreted as illustrative and not in a limiting sense.

I claim:

1. An archery arrow testing apparatus comprising a pair of upright flat stands, a pair of pedestals, the stands each having a pair of spaced apart thin flat upright legs, vertically extending slots in said pedestals sized to receive and support said thin flat upright legs when said legs are engaged in said slots, a rod, horizontally extending holes in said pedestals with opposite ends of said rod engaged in said holes connecting said pedestals together in a supported upright position, pairs of revolving thin metal discs, and means mounting said pairs of said discs on each of said stands with said discs being rotatable relative to said pedestals enabling an archery arrow to be spun in circumferential orbit on said discs for human eye scrutiny to ascertain trueness of an orbiting archery arrow.

2. The archery arrow testing apparatus of claim 1 wherein said means for mounting the sets of revolving thin metal discs being arranged to support the discs in such a way that the discs all are provided with a horizontal axes but with the axes being spaced from one another in such a way that each set of discs are oriented to define a nip for receiving an arrow.

3. An archery arrow testing apparatus of claim 1 wherein each of the pedestals is comprised of three pieces including end pieces and a middle piece, the middle piece having a slot therein, all of the pieces being relatively flat, and glue means being disposed between the flat pieces securing the pieces in side-by-side relation and with the thin flat upright legs being mounted in said slot.

4. An archery arrow testing apparatus of claim 1 wherein said rod is comprised of a stiff material and with the stands being slidable along the length of said rod into preselected positions for maintaining a desired spacing between the stands.

5. An archery arrow testing apparatus comprising a pair of upright flat stands, a pair of pedestals, the stands each having a pair of spaced apart thin flat upright legs, vertically extending slots in said pedestals sized to receive and support said thin flat upright legs when said legs are engaged in said slots, a stiff metallic rod, horizontally extending holes in said pedestals with opposite ends of said stiff metallic rod engaged in said holes connecting said pedestals together in a supported upright position, pairs of revolving thin metal discs with each pair having a nip for receiving an archery arrow, and means mounting said pairs of said discs on each of said stands with said discs being rotatable relative to said pedestals enabling an archery arrow to be spun in circumferential orbit on said discs in said nips for human eye scrutiny to ascertain trueness of an orbiting archery arrow.

6. The archery arrow testing apparatus of claim 5 wherein said means for mounting the sets of revolving thin metal discs being arranged to support the discs in such a way that the discs all are provided with a horizontal axes but with the axes being spaced from one another.

7. An archery arrow testing apparatus of claim 5 wherein each of the pedestals is comprised of three pieces including end pieces and a middle piece, the middle piece having an upwardly opening slot therein, all of the pieces being relatively flat, and glue means being disposed between the flat pieces securing the pieces in side-by-side relation and with the thin flat upright legs being mounted in said upwardly opening slot, the end pieces provinding side closures for said slots.

8. An archery arrow testing apparatus comprising a pair of upright flat stands, a pair of pedestals, the stands each having a pair of spaced apart thin flat upright legs, vertically extending slots in said pedestals sized to receive and support said thin flat upright legs when said legs are engaged in said slots, a stiff metallic rod, horizontally extending holes in said pedestals with opposite ends of said stiff metallic rod engaged in said holes connecting said pedestals together in a supported upright position, pairs of revolving thin metal discs with each pair having a nip for receiving an archery arrow, and means mounting said pairs of said discs on each of said stands with said discs being rotatable relative to said pedestals enabling an archery arrow to be spun in circumferential orbit on said discs in said nips for human eye scrutiny to ascertain trueness of an orbiting archery arrow, said means for mounting the sets of revolving thin metal discs being arranged to support the discs in such a way that the discs all are provided with a horizontal axes but with the axes being spaced from one another, each of the pedestals is comprised of three pieces including end pieces and a middle piece, the middle piece having an upwardly opening slot therein, all of the pieces being relatively flat, and glue means being disposed between the flat pieces securing the pieces in side-by-side relation and with the thin flat upright legs being mounted in said upwardly opening slot, the end pieces providing side closures for said slots.

* * * * *